US006621985B1

(12) United States Patent
Thweatt, Jr.

(10) Patent No.: US 6,621,985 B1
(45) Date of Patent: Sep. 16, 2003

(54) ELECTRIC WATER HEATER

(75) Inventor: Carlisle Thweatt, Jr., South Haven, MI (US)

(73) Assignee: Sherwood-Templeton Coal Company, Inc., Indianapolis, IN (US)

( * ) Notice: Subject to any disclaimer, the term of this patent is extended or adjusted under 35 U.S.C. 154(b) by 0 days.

(21) Appl. No.: 10/139,825

(22) Filed: May 7, 2002

(51) Int. Cl.[7] ..... F24H 1/10; H05B 3/78
(52) U.S. Cl. ..... 392/485; 392/465; 392/466
(58) Field of Search ..... 392/465, 485, 392/488, 466

(56) References Cited

U.S. PATENT DOCUMENTS 2,640,138 A * 5/1953 Merritt ..... 392/489
4,185,187 A * 1/1980 Rogers ..... 392/489
4,564,962 A * 1/1986 Castleberry et al. ..... 4/541.2
5,400,432 A * 3/1995 Kager et al. ..... 392/492
5,408,578 A * 4/1995 Bolivar ..... 392/490
5,724,478 A 3/1998 Thweatt
5,878,192 A * 3/1999 Jackson ..... 392/452
6,080,973 A 6/2000 Thweatt, Jr.

* cited by examiner

*Primary Examiner*—Thor Campbell
(74) *Attorney, Agent, or Firm*—Price, Heneveld, Cooper, Dewitt & Litton

(57) ABSTRACT

A spa system includes a tub, a pump, an electrical heater, and a tubing system interconnecting the tub, pump, and electric heater to provide recirculating flow of water through the spa system. The electrical heater includes a housing made of a polymer material and defining an internal passageway adapted for fluid flow through the housing. The housing has a first opening in fluid communication with the passageway, and a pair of access openings. The housing further includes a second opening in fluid communication with the tubing system. The heater also includes a heater tube defining a first end connected to the first opening in the housing. An elongated electrical heating element is at least partly disposed within the outer tube, and has opposite ends extending out of the first end of the heater tube and through the pair of access openings. The electrical heater includes compressions fittings sealingly connecting the heater tube and the elongated heating element to the housing.

20 Claims, 2 Drawing Sheets

ELECTRIC WATER HEATER

BACKGROUND OF THE INVENTION

Electric flow-through water heaters are commonly utilized to heat circulating water for use with a spa/hot tub and other such applications. Electric flow-through water heaters commonly employ an electrical heating element disposed in a metallic vessel such that the heating element is in contact with the flow of water to provide heat exchange to the water as it flows along the heating element. In addition, a water pump is generally used to continuously circulate water through the heater vessel. In the conventional water heating systems, a thermostat is typically disposed within the hollow of the vessel to sense the temperature of the heated water, and the heating element is generally controlled based on the sensed water temperature. According to many conventional approaches, the electric heater is controlled in response to the sensed temperature of the water to maintain a desired water temperature.

Modern pools, spas and the like may utilize a variety of chemicals in the water to prevent growth of bacteria or other undesirable organisms. Such chemicals may be highly reactive/corrosive, thus limiting the life of the heater element when exposed to the water and chemicals. Although stainless steel is corrosion resistant, the highly reactive nature of the chemicals degrades even known stainless steel heater elements. Known heater elements include a tubular stainless steel outer jacket with an inner conductive wire extending through the outer jacket. A dielectric insulation such as magnesium oxide or other suitable dielectric medium is disposed around the inner conductive wire to permit transfer of heat from the inner conductive wire to the outer jacket, while providing electrical insulation between the inner conductive wire and the outer jacket. The magnesium oxide or other powder is packed tightly to promote heat conduction from the inner conductive wire to the stainless outer jacket. In an attempt to alleviate the corrosion problems caused by the water and corrosive chemicals, a titanium outer sleeve material has been tried. However, the high temperatures of the heating element cause the titanium to stress relieve, thus significantly reducing the compaction and heat conduction capability of the magnesium oxide.

One type of known water heater includes a generally cylindrical hollow vessel that may be made of a metal or polymer material. An electrical heating element is disposed within the housing, with opposite ends of the heating element extending through the sidewall of the housing to provide an electrical connection to the heating element. If the hollow vessel is made of a metal material that is the same as the electric heating element, the electric heating element may be welded to the vessel where the heating element passes through the sidewall. However, such welding operations may be difficult and/or expensive particularly if the vessel and heating element are made of a dissimilar material. Alternately, another known arrangement is illustrated in U.S. Pat. No. 6,080,973. This heater arrangement includes a hollow vessel that is made of a polymeric material, and compression fittings are utilized to seal the joint between the electrical heating element and the hollow vessel. This arrangement utilizes metal support members that position the heating element within the vessel to prevent the heating element from contacting and damaging the polymeric walls of the vessel.

Thus, a heater alleviating the problems associated with existing water heaters would be desirable.

SUMMARY OF THE INVENTION

One aspect of the present invention is a spa system including a tub having a sufficient size to accommodate an adult human. The spa system includes a powered pump, an electrical heater, and a tubing system interconnecting the tub, pump, and electric heater to provide recirculating flow of water through the spa system. The electrical heater includes a housing made of a polymer material and defining an internal passageway adapted for fluid flow through the housing. The housing has a first opening in fluid communication with the passageway, and a pair of access openings. The housing further includes a second opening in fluid communication with the tubing system. The heater also includes a heater tube defining a first end connected to the first opening in the housing. An elongated electrical heating element is at least partly disposed within the outer tube, and has opposite ends extending out of the first end of the heater tube and through the pair of access openings. The electrical heater includes a first compression fitting sealingly connecting the heater tube to the housing at the first opening, and a pair of compression fittings sealingly connect the elongated heating element to the housing at the access openings.

Another aspect of the present invention is an electrical heater including a housing made of a polymer material. The housing has an internal passageway permitting fluid flow through the housing. The heater includes a tube having a first end connected to the housing in fluid communication with the passageway. An elongated metallic electrical heater element has a portion disposed within the tube, and has opposite ends extending out of the first end of the tube. The ends of the heating element have connectors adapted for coupling to an electrical power source. The housing has a first sidewall portion with a first opening therethrough in fluid communication with the passageway. The housing also has a second sidewall portion having a pair of access openings therethrough. The first opening and the pair of access openings each have first and second portions. The first portions have a diameter that is larger than the second portion to form pockets. At least a portion of the first end of the tube is disposed in the first opening, and the opposite ends of the elongated metallic heating element extend through the access openings with the connectors disposed external of the housing. A first resilient ring is disposed in the pocket of the first opening, and a first compression member is operably coupled to the housing to compress the first resilient ring and provide a seal between the tube and the housing. A pair of resilient rings are disposed in the pockets of the access openings, and a second compression member is operably coupled to the housing to compress the pair of resilient rings and provide a seal between the elongated metallic electrical heating element and the housing.

Yet another aspect of the present invention is an electrical heater including a housing made of a polymer material and having an internal passageway providing fluid flow through the housing. The housing has first and second openings to the passageway and at least one access opening open to the passageway. The heater includes an elongated tube having a first end secured to the first opening of the housing. An elongated electrical heating element is at least partially disposed in the elongated tube. The heating element has an end extending through the access opening such that the end is accessible from outside the housing to permit coupling of an electrical line to the end of the heating element. A compression fitting sealingly couples the electrical heating element to the housing at the access opening.

These and other features, advantages, and objects of the present invention will be further understood and appreciated by those skilled in the art by reference to the following specification, claims, and appended drawings.

BRIEF DESCRIPTION OF THE DRAWINGS

FIG. 2;

FIG. 3; FIG. 3.

DETAILED DESCRIPTION OF PREFERRED EMBODIMENT

Figure 1:
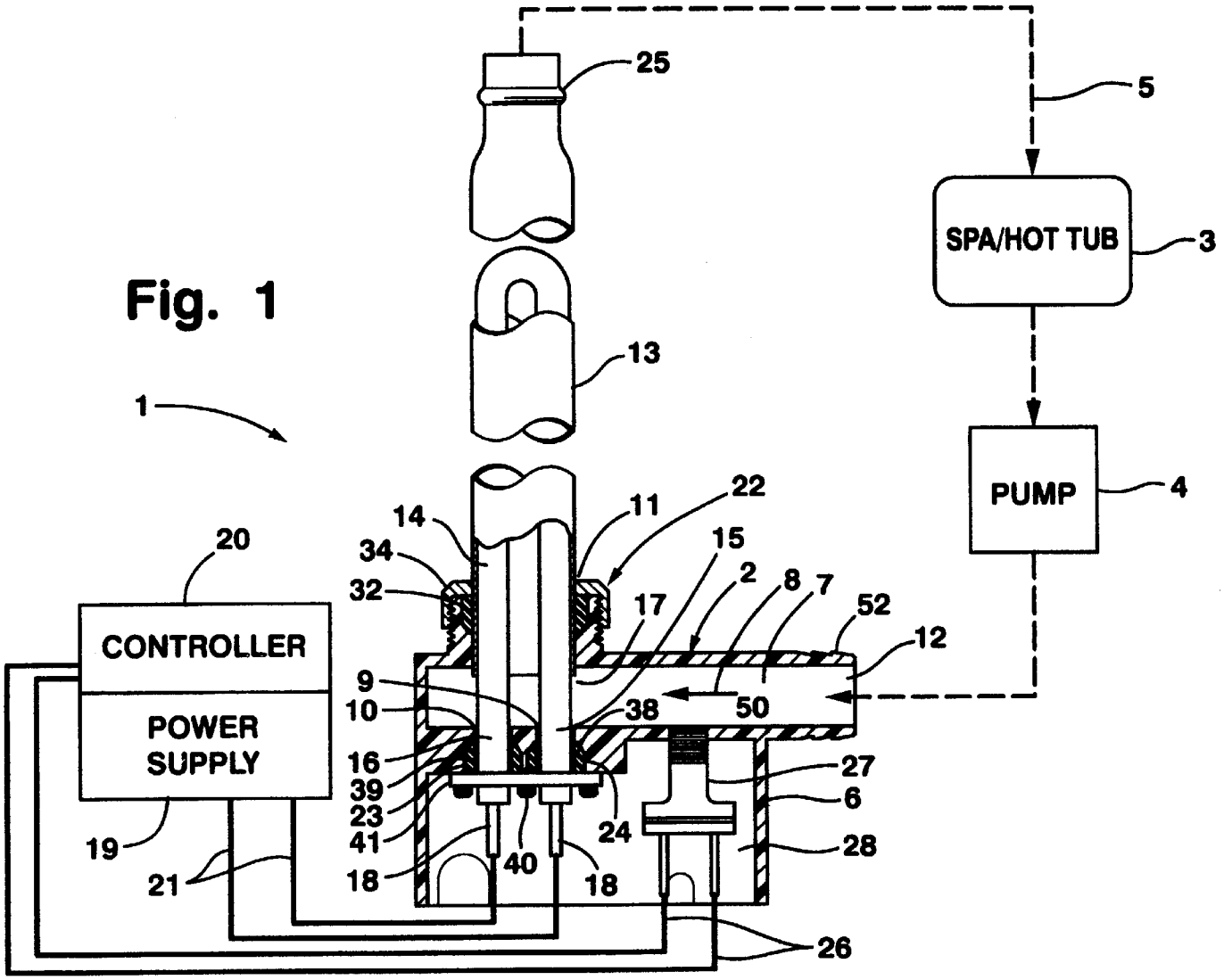
FIG. 1 is a partially schematic, fragmentary cross-sectional view of a spa system according to the present invention.
Figure 5:
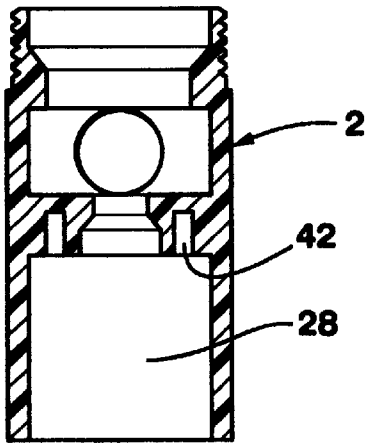
FIG. 5 is a cross-sectional view of the housing taken along the line V—V.

For purposes of description herein, the terms "upper, " "lower, " "right, " "left, " "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a spa system 1 includes a water heater assembled to a spa/hot tub 3, and an electrical pump 4 to circulate water through the system. A tubing system 5 interconnects the tub 3, pump 4, and heater assembly 2 to provide recirculating flow of water through the spa system. The heater assembly 2 includes a housing 6 made of a polymer material and defining an internal passageway 7 adapted for flow of water 8 through the passageway 7. The housing includes first and second access openings 9, 10. A heater tube 13 is connected to a first opening 11 in fluid communication with the passageway 7, and a second opening 12 is in fluid communication with the passageway 7 is operably connected to the tubing system 5. An elongated electrical heating element 14 is at least partially disposed within the tube 13, and includes opposite ends 15 and 16 that extend out of a first end 17 of tube 13 and through access openings 9 and 10. Connectors 18 at the ends of heating element 14 are operably connected to a power supply 19 and controller 20 via electrical lines 21. A first compression fitting 22 sealingly connects the heater tube 13 to the housing 6 at the first opening 11 and a pair of compression fittings 23 and 24 sealingly connect the heating element 14 to the housing 2 at the access openings 9 and 10.

In a preferred embodiment, the elongated heater element 14 includes an outer sheath made of a titanium material, and inner sheath made of a stainless steel material in substantially the same manner as disclosed in co-pending patent application Ser. No. 09/827,232, filed Apr. 5, 2001, and entitled ELECTRIC WATER HEATER, the entire contents of which are hereby incorporated by reference. The heater tube 13 is preferably made of a titanium material, and includes a fitting 25 configured to connect the tube 13 to the tubing system 5. The power supply 19 and controller 20 supply electrical current in a controlled manner, such as disclosed in the above-identified U.S. Pat. No. 6,080,973, entitled ELECTRIC WATER HEATER, issued Jun. 27, 2000, the entire contents of which are hereby incorporated by reference. A pressure switch 27 is disposed in an external cavity 28 of housing 2. The pressure switch 27 is configured to provide a signal when the water pressure in the passageway 7 has dropped below a pre-selected value. The pressure switch 27 is operably connected to the controller 20 via lines 26. Controller 20 can be configured to turn off the power supplied to the heating element 14 if the water pressure drops. This arrangement prevents overheating of the heating element 14 and related components if, for example, pump 4 fails, or the flow of water 8 is otherwise disrupted.

Figure 3:
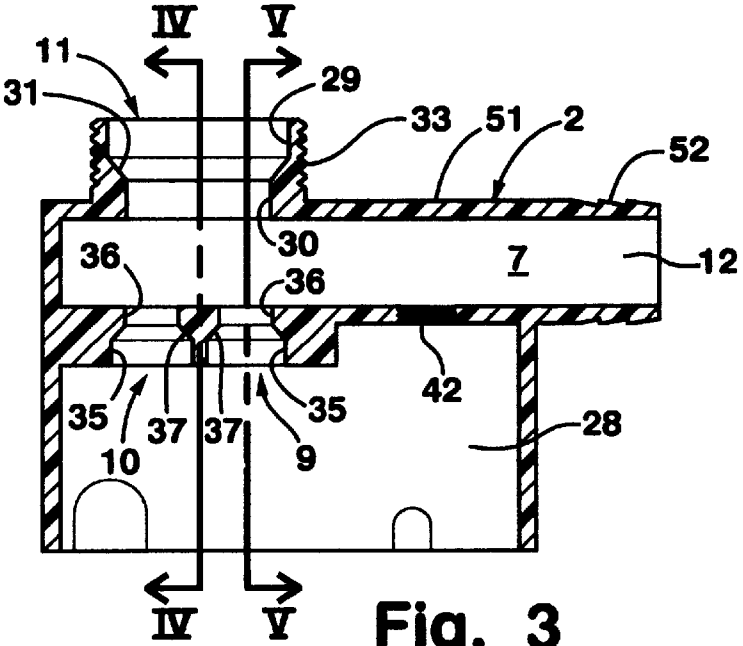
FIG. 3 is a cross-sectional view of the housing of FIG. 2 taken along the line III—III.
Figure 2:
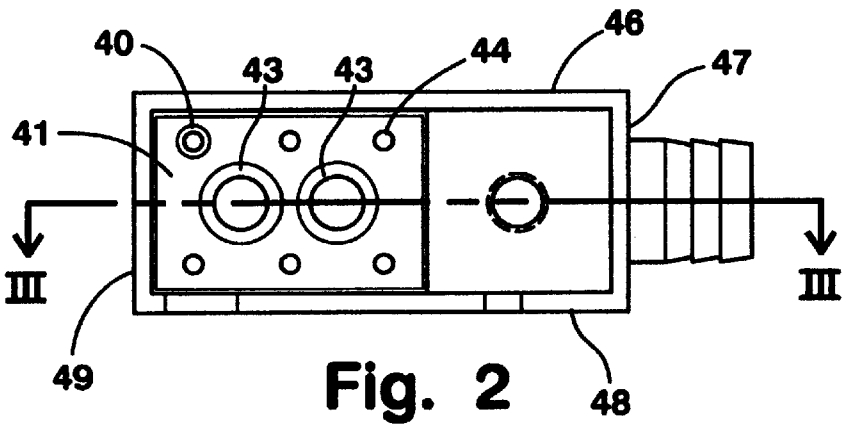
FIG. 2 is a bottom plan view of the housing of the heater of FIG. 1.
Figure 4:
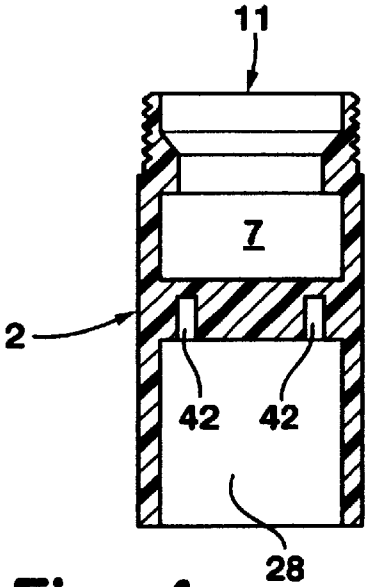
FIG. 4 is a cross-sectional view of the housing of FIG. 3 taken along the line IV—IV.

With further reference to FIG. 3, first opening 11 includes a generally cylindrical larger diameter outer portion 29, a smaller diameter inner portion 30, and a tapered sidewall portion 31 extending between the wall portions 29 and 30. When assembled, the end 17 of heater tube 13 extends into opening 11 and through the smaller diameter portion 30. An elastomeric ring 32 (FIG. 1) is positioned around the heater tube 13 in the portion of the opening 11 adjacent the larger diameter portion 29 and tapered portion 31. A ring-like threaded compression member 34 is threadably received on the threaded extension 33 of housing 2. As the compression member 34 is tightened, the elastomer ring 32 is deformed, and fits tightly against the sidewalls of the opening 11 to thereby provide a fluid tight seal between the heater tube 13 and housing 2. The elastomer ring 32 thereby provides a fluid tight seal despite the differences in thermal coefficients of expansion between the titanium tube 13 and polymer housing 2. Openings 9 and 10 also include larger diameter outer portions 35, smaller diameter inner portions 35, and tapered sidewall portions 37 extending between the larger and smaller diameter portions of the openings 9 and 10. Elastomeric rings 38 and 39 extend around the end portions 15 and 16 of heater element 14. A compression member such as a plate 41 includes clearance openings 43 that receive the end portions 15 and 16 of heating element 14. A plurality of screws 40 or the like extend through smaller openings 44 in plate 41, and are received in threaded openings 42 in housing 2. The plate 41 thereby compresses the elastic rings 38 and 39 such that the rings fit tightly against the sidewall portions 35 and 37 of openings 9 and 10 to provide a water tight seal at the ends of the heating element 14.

Cavity 28 of housing 2 is defined by sidewall portions 46, 47, 48, and 49, that extend from the generally tubular portion 51 of housing 2. The threaded end portion 50 of pressure switch 27 (FIG. 1) is threadably received in a threaded opening 42 through the tubular portion 51 of housing 2. When fully assembled, a silicone material or the like is utilized to fill the cavity 28, thereby encapsulating the electrical connectors 18 of heating element 14, and the pressure switch to further ensure that a water tight seal is achieved. The tubular portion 51 of housing 2 includes a standard fitting 52 at second opening 12 to permit connection of the housing 2 to the tubing system 5.

Although the polymer housing 2 and the titanium heater tube 13 have different coefficients of thermal expansion, the compression fitting provides a secure, water tight seal as the temperature varies. Furthermore, the compression fittings eliminate welding operations that are potentially expensive and difficult to properly achieve.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A spa system, comprising:

a tub having sufficient size to accommodate an adult human;

a powered pump;

an electrical heater;

a tubing system interconnecting said tub, pump, and said electrical heater to provide recirculating flow of water through said spa system; and wherein:

said electrical heater includes a housing made of a polymer material and defining an internal passageway adapted for fluid flow through said housing, said housing having a first and second openings in fluid communication with said passageway, and a pair of access openings, said heater further including a heater tube defining a first end connected to said first opening in said housing in fluid communication with said internal passageway, said heater including an elongated electrical heating element at least partially disposed within said heater tube and having opposite ends extending out of said first end of said heater tube and through said pair of access openings, and wherein:

said electrical heater includes a first compression fitting sealingly connecting said heater tube to said housing at said first opening, and a pair of compression fittings sealingly connecting said elongated heating element to said housing at said pair of access openings.

2. The spa system of claim 1, wherein:

said electrical heating element includes an outer sheath made of a titanium material, and an electrical resistance wire extending along said electrical heating element inside said outer sheath.

3. A spa system, comprising:

a tub having sufficient size to accommodate an adult human;

a powered pump;

an electrical heater a tubing system interconnecting said tub, pump, and said electrical heater to provide recirculating flow of water through said spa system; and wherein:

said electrical heater includes a housing made of a polymer material and defining an internal passageway adapted for fluid flow through said housing, said housing having a first opening in fluid communication with said passageway, and a pair of access openings, said heater further including a second opening in fluid communication with said tubing system and a heater tube defining a first end connected to said first opening in said housing, said heater including an elongated electrical heating element at least partially disposed within said outer tube and having opposite ends extending out of said first end of said heater tube and through said pair of access openings;

said electrical heater including a first compression fitting sealingly connecting said heater tube to said housing at said first opening, and a pair of compression fittings sealingly connecting said elongated heating element to said housing at said pair of access openings; and wherein:

said first compression fitting includes a threaded compression member and an elastomeric ring;

said first opening includes a generally conical tapered wail portion;

said housing having an externally threaded extension defining said first opening; and said heater tube extending through said elastomeric ring with said threaded compression member threadably engaging said externally threaded extension and compressing said elastomeric ring into sealing contact with tapered wall portion of said first opening.

4. The spa system of claim 3, wherein:

said pair of access openings each include tapered sidewall portions;

said pair of compression fittings includes a pair of resilient rings sealingly engaging said tapered sidewall portions, said pair of compression fittings further including at least one compression member compressing said resilient rings into sealing contact with said tapered sidewall portions.

5. The spa system of claim 4, wherein:

said electrical heating element has threaded connectors at said opposite ends adapted to electrically couple said electrical heating element to a source of electrical power.

6. The spa system of claim 5, wherein:

said heater tube is made of a titanium material.

7. The spa system of claim 6, wherein:

said housing is made of a polyvinyl chloride material.

8. An electrical heater, comprising:

a housing made of a polymer material, said housing having an internal passageway permitting fluid flow through said housing;

a tube having a first end connected to said housing in fluid communication with said passageway;

an elongated metallic electrical heating element having a portion disposed within said tube and having opposite ends extending out of said first end of said tube, said ends of said heating element having connectors adapted for coupling to an electrical power source;

said housing having a first sidewall portion with a first opening therethrough in fluid communication with said passageway, and a second sidewall portion having a pair of access openings therethrough, said first opening and said pair of access openings each having first and second portions, said first portions having a diameter that is larger than said second portion to form pockets;

at least a portion of said first end of said tube disposed in said first opening, and said opposite ends of said elongated metallic heating element extending through said access openings with said connectors disposed external of said housing;

a first resilient ring disposed in said pocket of said first opening;

a first compression member operably coupled to said housing to compress said first resilient ring and provide a seal between said tube and said housing;

a pair of resilient rings disposed in said pockets of said access openings; and at least a second compression member operably coupled to said housing to compress said pair of resilient rings and provide a seal between said elongated metallic electrical heating element and said housing.

9. The electrical heater of claim 8, wherein:

said electrical heating element includes an outer sheath made of a titanium material, and an electrical resistance wire extending along said electrical heating element inside said outer sheath.

10. The electrical heater of claim 8, wherein:

said first opening and said access openings each include generally conical tapered sidewall portions.

11. The electrical heater of claim 10, wherein:

said housing includes an externally threaded portion at said first opening; and said first compression comprises a threaded ring-like fitting engaging said externally threaded portion to compress said first resilient ring.

12. The electrical heater of claim 11, wherein:

said housing includes at least one threaded opening adjacent said access openings, said second compression member comprising a plate having a pair of clearance openings therethrough, said ends of said heating element extending through said clearance openings; and including:

at least one threaded member engaging said threaded opening in said housing to push said second compression member into said pair of rings.

13. An electrical heater, comprising:

a housing made of a polymer material and having an internal passageway providing fluid flow through said housing, said housing having first and second openings to said passageway and at least one access opening open to said passageway;

an elongated tube having a first end secured to said first opening such that said elongated tube is in fluid communication with said internal passageway of said housing;

an elongated electrical heating element at least partially disposed in said elongated tube and having an end extending out of said first end and through said access opening such that said end is accessible from outside said housing to permit coupling of an electrical line to said end; and a compression fitting sealingly coupling electrical heating element to said housing at said access opening.

14. The electrical heater of claim 13, wherein:

said electrical heating element includes an outer sheath made of a titanium material, and an electrical resistance wire extending along said electrical heating element inside said outer sheath.

15. The electrical heater of claim 13, wherein:

said compression fitting comprises a first compression fitting and said end of said electrical heating element comprises a first end, said electrical heating element defining a second end extending through said housing; and including:

a second compression fitting sealingly coupling said electrical heating element to said housing at said second end.

16. The electrical heater of claim 15, wherein:

said access opening comprises a first access opening, said housing including a second access opening, said second end extending through said second access opening.

17. The electrical heater of claim 16, wherein:

said housing includes a threaded extension defining said first opening to said passageway, said first opening including a tapered sidewall portion; and including:

said first end of said elongated tube at least partially disposed in said first opening;

an elastomeric ring disposed in said first opening;

a ring-like threaded compression fitting engaging said threaded extension and compressing said elastomeric ring.

18. The electrical heater of claim 17, wherein:

said heater tube is made of a titanium material; and said electrical heating element includes an outer sheath made of a titanium material, and an electrical resistance wire extending along said electrical heating element inside said outer sheath.

19. The electrical heater of claim 18, wherein:

said passageway defines an axis; and said heater tube extends from said housing transverse to said axis.

20. The electrical heater of claim 19, wherein:

said housing is made of a polyvinyl chloride material.

* * * * *